United States Patent [19]

Corini

[11] 4,133,456

[45] Jan. 9, 1979

[54] TEMPERATURE-CONTROLLED LIQUID DISPENSER

[76] Inventor: Louis J. Corini, 6411 Hawthorne St., Philadelphia, Pa. 19149

[21] Appl. No.: 791,061

[22] Filed: Apr. 26, 1977

[51] Int. Cl.[2] ..... B67D 5/62

[52] U.S. Cl. ..... 222/146 HE; 222/529

[58] Field of Search ..... 222/105, 76, 146 H, 222/146 HE, 146 C, 212, 529, 183

[56] References Cited

U.S. PATENT DOCUMENTS

| | | | |
|---|---|---|---|
| 2,876,937 | 3/1959 | Wilson | 222/529 |
| 3,445,039 | 5/1969 | Brodsky et al. | 222/70 |
| 3,448,897 | 6/1969 | Sterling | 222/105 |

*Primary Examiner*—Stanley H. Tollberg
*Attorney, Agent, or Firm*—Benasutti Associates, Ltd.

[57] ABSTRACT

A temperature controlled liquid dispenser having an insulated receptacle with improved ventilation characteristics; and having a novel dispensing valve. A novel valve is described which can be removed from the liquid dispenser and the portable container thereby eliminating the requirement of emptying the container before removing it from the dispenser, yet allowing removal of the valve from the container whereby the container can be capped and the valve used again.

The receptacle is adapted to receive a portable liquid filled container which is temperature controlled by a thermo-electric device in contact with a heat conductive lining which engages a portion of the interior of the receptacle for heating or cooling the contents thereof. Heat insulation-filled receptacle channel portions extend downwardly from the main body of the receptacle on either side of heat exchange fins which are attached to and extend downwardly away from the thermo-electric device. This arrangement, together with proper placement of air vents and an air circulating fan, serves to provide improved ventilation of the dispenser.

9 Claims, 5 Drawing Figures

TEMPERATURE-CONTROLLED LIQUID DISPENSER

BACKGROUND OF THE INVENTION

I. Field of the Invention

This invention relates to temperature controlled liquid dispensers.

II. Description of the Prior Art

The Gonzalez U.S. Pat. No. 3,480,015 and the Brodsky et al. U.S. Pat. No. 3,445,039 of which applicant is a joint inventor, both describe temperature controlled insulated receptacles which receive liquid filled containers. The Brodsky et al. patent additionally describes a thermo-electric temperature controlled insulated liquid dispenser using an electrically actuated valve shut-off means to provide access to the liquid.

It is desirable to provide a shut-off valve and delivery means for access to the temperature controlled liquid which is simple, yet which can be removed from the liquid dispenser with the liquid filled container. At the same time, the valve and delivery means should be readily removable from the container itself without the need of special requirements on the liquid filled container.

The effectiveness of such dispensers depends upon placement of insulation and good air ventilation in the design of the dispenser. A considerable amount of heat is generated by the power supply which drives the thermo-electric unit. The power supply is often contained in a closed environment near the space whose temperature is to be controlled. The quick and efficient removal of the heat from this space makes the insulation surrounding the container more effective. In addition, fresh air from the ambient atmosphere must be brought in across the heat exchange means of the dispenser and removed relatively quickly from the environment of the temperature controlled container to insure effective operation of the dispenser. Mere use of ventilation fans with placement of air vents in a portion of the dispenser does not insure efficient movement of air through the dispenser and away from the liquid which is being heated or cooled.

SUMMARY OF THE INVENTION

Applicant's preferred embodiment liquid dispenser is equipped with a temperature controlled insulated receptacle for receiving portable liquid filled containers, the contents of which are to be heated or cooled by a temperature control means which is in contact with the receptacle portion of the dispenser.

Access to the liquid in the portable container is accomplished through the use of a shut-off valve means and a delivery means which interfaces with the liquid filled container. Applicant's valve means and delivery means, when mating with or engaging the container, place few requirements on the design of the container. For example, plastic containers with handle portions and conventional threaded nozzle portions for receiving a cap can be used with applicant's invention.

In the preferred embodiment, applicant's delivery means comprises a gasket nipple with a tubular portion, the nipple being placed intermediate the valve means and the nozzle portion of the liquid filled container. The preferred embodiment valve means acts to close or squeeze off the tubular portion of the nipple when the valve means is in the closed position. The preferred embodiment valve means is pivotal between a closed position and an open position, the liquid in the container being free to flow through the tubular portion when the valve means is in the open position.

Applicant's preferred embodiment dispenser operates to deliver liquid from the container within the temperature control receptacle to a separate external container provided by the ultimate user or consumer of the liquid. To insure simple operation of the preferred embodiment valve means, applicant requires only that the user place his external or demand container under the delivery means and push the demand container against a lever portion of the valve means which then pivots about a separate body portion of the valve means which is removably attached to the liquid filled container. The lever portion is biased to return to the closed position when the demand container is filled with liquid and removed by the user. In the preferred embodiment, the biasing means is a rubber spring or band, which engages both the body portion and the lever portion. Hence, beside the consumer, no external power source such as electricity is required to operate the valve means in applicant's invention.

In the preferred embodiment, the receptacle portion of applicant's invention is supported above the dispenser base by a rear chamber portion of the dispenser. Within the rear chamber portion, the power supply for operating the thermo-electric temperature control unit is housed. The thermo-electric temperature control unit which is in contact with the receptacle is provided with a heat exchange means for properly ventilating one side of the thermo-electric unit. In addition, ventilation is required to dissipate the heat generated by the power supply contained in the rear chamber. This rear chamber is confined and in the preferred embodiment is immediately adjacent the underside or bottom of the insulated receptacle. Hence, optimum air movement through this chamber is critical to the efficient operation of the dispenser. To provide this optimum air movement, the preferred embodiment insulated receptacle of applicant's invention comprises downwardly extending insulation-filled channel portions which extend into the rear chamber portion of the dispenser. Venting means such as apertures in opposite side walls of the chamber and an air circulating means, such as a fan, are also provided in the rear chamber. When the fan is activated, air is pulled in through the openings or vent means and it is guided along the heat exchange means by the insulation-filled channel portions of the receptacle from above. Channel means thereby provide a partially insulated channel-like path for the air to move through when the air circulating means is activated. Placement of the intake vents near the top of the rear chamber in a side wall adjacent one end of the heat exchange means and placement of the exhaust vents in the opposite side of the rear chamber near the base of the dispenser assist in assuring that the ambient atmosphere will be pulled first along the heat exchange means, and then exhausted away from the insulated receptacle portion of the dispenser.

To further assist in defining the channel or path for movement of air through the rear chamber in optimally ventilating the chamber, a horizontally disposed channel plate is provided in the preferred embodiment which engages one side of the rear chamber just below the intake vents and which has an aperture therein along with a downwardly extending flange which surrounds the aperture. In the preferred embodiment, the blade of the fan or air circulating means is located within the region defined by the downwardly extending flange and aperture in the channel plate and, as the blade rotates, air is pulled in through the intake vents along the heat exchange means and down through the aperture in the channel plate to be exhausted through the exhaust vents. To further assist in the downward movement of the air at the opposite end of the heat exchange means from the intake vents, a downwardly curved plate or member is provided to further define the channel or pathway for movement of the air through the chamber.

Accordingly, it is an object of the present invention to provide a temperature controlled liquid dispenser.

It is another object of the present invention to provide a temperature controlled liquid dispenser for heating or cooling a liquid filled portable container.

It is another object of the present invention to provide a temperature controlled liquid dispenser having a simple shut-off valve and delivery means for mating with a portable liquid filled container and for dispensing the liquid therefrom.

It is another object of the present invention to provide a temperature controlled liquid dispenser having a simple shut-off valve and delivery means which is removable from the dispenser with the container and also removable from the container.

Another object of the present invention is to provide a more efficient temperature controlled liquid dispenser.

It is another object of the present invention to provide a more efficient ventilation of a temperature controlled liquid dispenser.

This and other objects of my invention will become apparent from the following description with reference to the accompanying drawings.

DETAILED DESCRIPTION OF THE DRAWINGS

Figure 1:
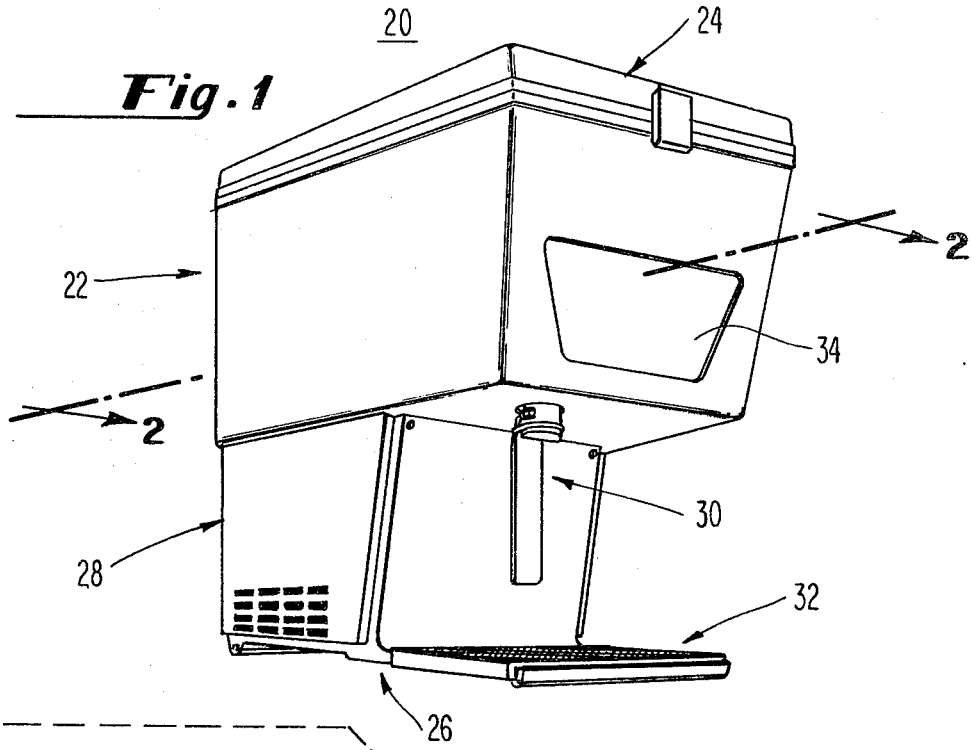
FIG. 1 is a perspective view of the preferred embodiment liquid dispenser of applicant's invention.

Although specific forms of the invention have been selected for illustration in the drawings, and the following description is drawn in specific terms for the purpose of describing these forms of the invention, this description is not intended to limit the scope of the invention which is defined in the appended claims.

Referring to the figures, FIG. 1 shows the preferred embodiment temperature controlled liquid dispenser 20. The dispenser comprises a heat insulated receptacle designated generally 22; a lid designated generally 24 which is hinged in the back of the dispenser, the hinge not shown in FIG. 1; a base means designated generally 26 for supporting the various parts of the dispenser, the base means comprising a rear chamber portion shown enclosed by a shroud designated generally 28; valve shut-off means designated generally 30; and tray portion designated generally 32. The outer front surface of the receptacle 22 shows a trapezoidal-shaped indentation 34 for accommodating a name plate or identification tag. Obviously, any shaped indentation or other suitable means for identification could be provided if desirable.

Figure 2:
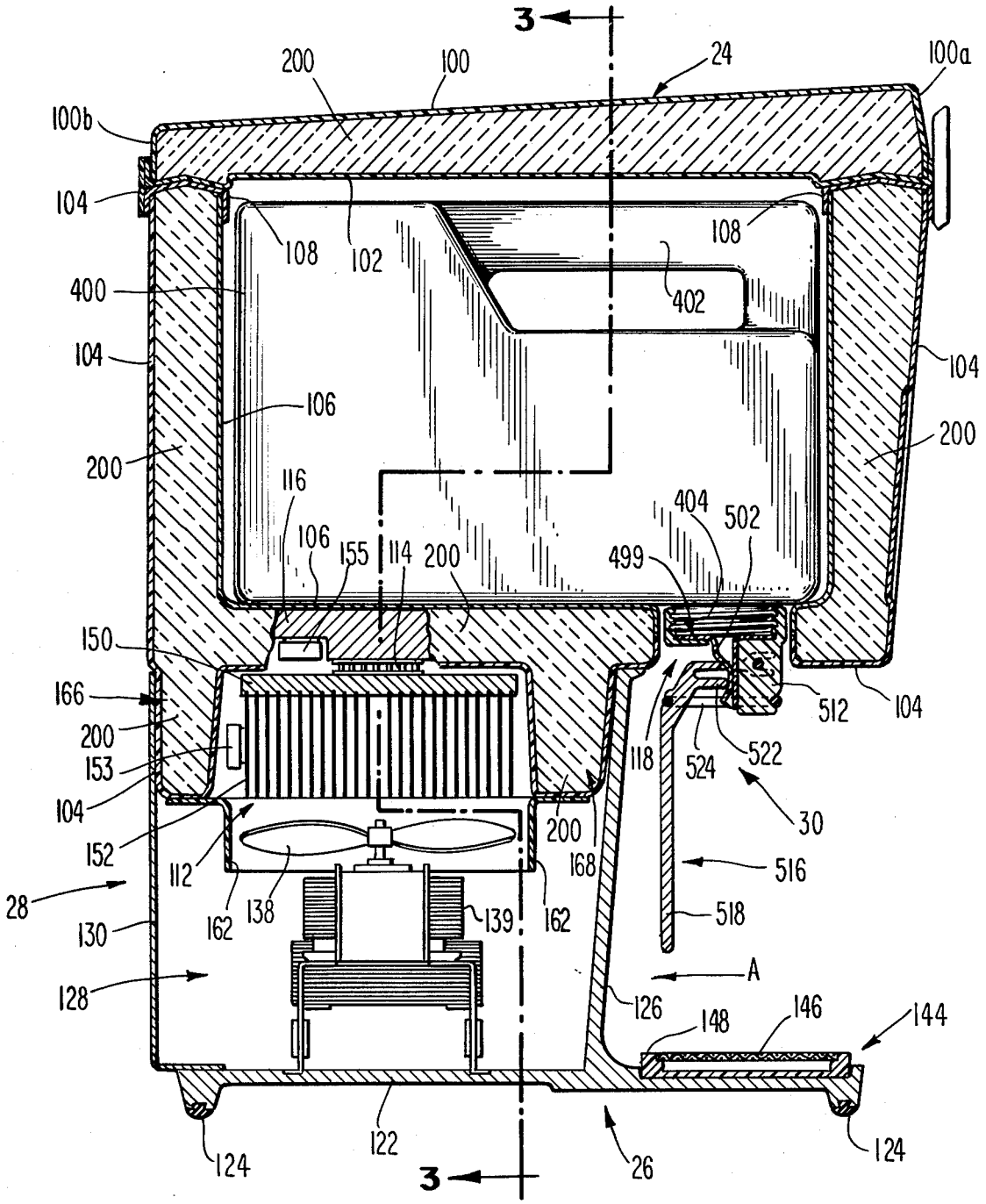
FIG. 2 is an enlarged cross-section of the preferred embodiment liquid dispenser of FIG. 1 taken along the lines and arrows 2—2 in FIG. 1.
Figure 3:
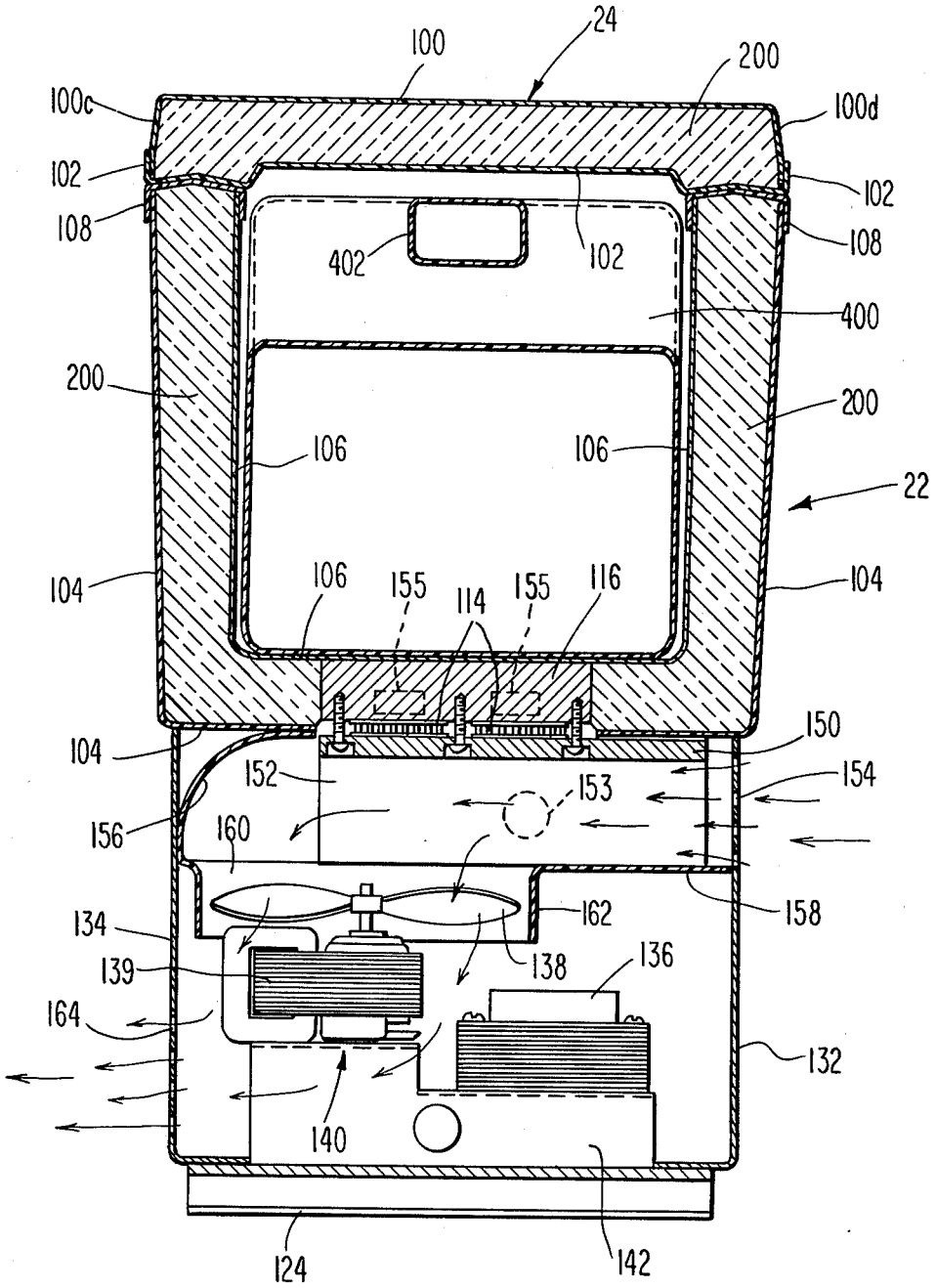
FIG. 3 is an enlarged cross-section of the preferred embodiment liquid dispenser of applicant's invention taken as indicated by the lines and arrows 3—3 in FIG. 2, showing the air flow through the vents indicated by the arrows in FIG. 3.

Referring now to FIGS. 2 and 3, the lid designated generally 24 comprises insulation material 200 which is encapsulated by outer surface 100 and inner surface or lid liner 102. The lid liner 102 overlaps the downwardly directed front, back and side portions of the surface 100. The lid is shown in a side cross-section in FIG. 2, taken as indicated by the lines and arrows 2—2 in FIG. 1 showing the front **100*a* and back 100*b* downwardly directed portions of the outer surface 100. FIG. 3 is a frontal cross-section showing the lid downwardly directed side portions 100*c* and 100*d* of surface 100**.

FIGS. 2 and 3 also show respectively the side cross-section and front cross-section of the insulated receptacle's substantially vertical wall and bottom portions. The wall and bottom portions of receptacle 22 are made up of insulation 200 partially encapsulated by a continuous outer surface 104 made of a material such as plastic and a continuous interior surface 106. However, the interior surface must be a heat conduction material such as metal. This interior surface 106 defines a thermal vessel which lines the interior cavity formed by the vertical wall and bottom portions of the insulated receptacle 22. The vertical wall portions of the receptacle 22 are capped by a plastic member 108 which surrounds the entire top perimeter of the receptacle and overlaps the surface 104 and 106 to finish encapsulation of the wall and bottom portion insulation material 200. In the preferred embodiment, the cap or enclosing surface 108 is also made of a material such as plastic.

The lid 24 is hinged or connected to the receptacle 22 by hinge 110 shown in FIG. 2. In the preferred embodiment, a Teflon or other plastic strip is attached in any suitable manner to the adjoining surfaces of the lid liner 102, which overlaps the outer surface 100 of the lid and the cap portion 108, which overlaps the outer surfaces 104 of the vertical portions of the receptacle. The lid can then be pivoted about the hinge point to open and place a receptacle or liquid into the insulated cavity formed by the receptacle 22.

FIG. 2 shows the insulation material of the bottom of the receptacle broken away to expose the temperature control means designated generally 112 for controlling the temperature of the contents of the receptacle. The basic thermal device is the thermo-electric unit 114 which, with the passage of current therethrough, will heat one side and cool the second. If the current is reversed, the process is reversed so that the first side is now cooled and the second side heated. Because of the unique characteristics of thermo-electric unit 114, the interior of the receptacle 22 can be either heated or cooled by the liquid dispenser of applicant's invention. Attached to one side of the thermo-electric unit 114 is a thermal block 116, which block is also in direct contact with the thermal vessel lining 106 of the receptacle 22. The insulation material 200 and the outer surface 104 surround the thermal block and thermo-electric unit. Since the thermal vessel lining 106 extends along the entire bottom of the receptacle and along the vertical sides of the receptacle and since this is in direct contact with the thermal plate which is either heated or cooled by the thermo-electric unit, the interior of the receptacle will become either hot or cold as a result of exposure to the surfaces of the thermal vessel lining 106.

One convenient way of placing liquid within the receptacle for heating and cooling, and then for readily dispensing that liquid, is to place a portable liquid filled container within the receptacle. Such a liquid container designated generally 400 is shown in place within the liquid dispenser and in contact with the thermal vessel lining 106 along the bottom of the container. The container is a conventional plastic container in the example shown in FIG. 2 having a handle portion 402 and a threaded nozzle portion 404 for receiving a complementally threaded cap which is readily placed on or off of the nozzle portion of the container. The nozzle portion of the container 400 is placed within an aperture 118 disposed within the bottom of the preferred embodiment receptacle. The valve means 30 is shown engaging the nozzle portion 404 of the liquid filled container 400 with a nipple gasket delivery means designated generally 499 disposed in between. The delivery means serves to guide the flow of liquid from within the container outwardly toward an external or demand container furnished by the user or consumer.

Figure 4:
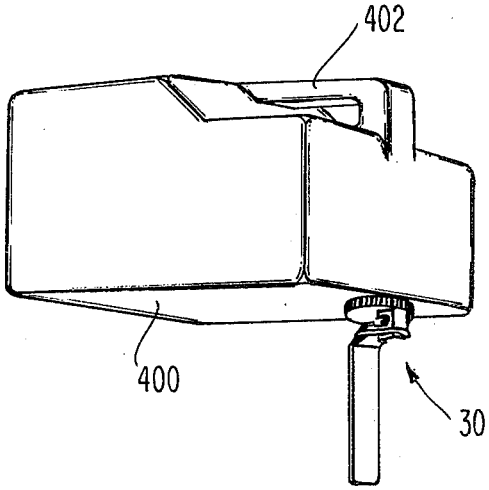
FIG. 4 is a perspective view of the preferred embodiment liquid container insert with valve means attached thereto.

FIG. 4 shows the preferred embodiment plastic container 400 in a perspective view having a handle 402. Valve means 30 is also shown attached to the container. Any suitable container could be substituted for the container of FIGS. 2, 3, and 4; however, in the preferred embodiment demonstrated here, a threaded nozzle portion for disposition within the aperture 118 is desirable.

Figure 5:
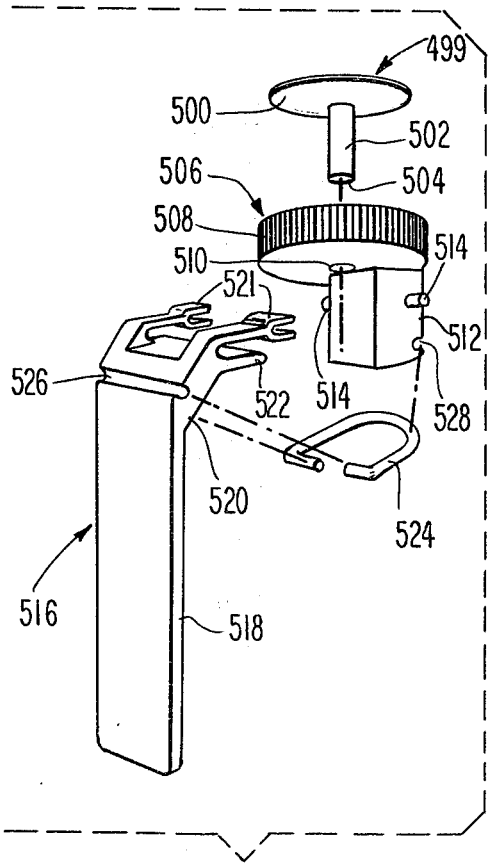
FIG. 5 is an enlarged view of the various parts of the valve means and delivery means of applicant's invention.

Referring to FIG. 5 for further details of the valve means and the delivery means, the delivery means can be seen to be a nipple gasket 499 made of resilient plastic or rubber or some other suitable resilient material. The nipple gasket is comprised of a substantially planar, and in the preferred embodiment, circular section 500 with a cylindrical tubular portion 502 attached thereto. The opening through the tubular portion from the bottom 504 up through the planar portion 500 is continuous allowing liquid to flow therethrough.

The valve means comprises a valve body designated generally 506 having an internally threaded valve cap 508 which, in turn, has an aperture 510 through the bottom through which the tubular portion 502 of the nipple gasket is inserted. The outer edge of the valve cap 508 is knurled to aid in threading the valve body 506 onto the threaded nozzle portion 404 of the container 400. Of course, it aids in removing the valve body from the container as well. Attached to the valve cap 508 is a member 512 which has, in the preferred embodiment, two fulcrum projections 514 extending from opposite sides.

The valve means also comprises a lever portion designated generally 516. The lever portion 516 comprises a longitudinal substantially planar lever 518, which has joined thereto, a transition member 520. The lever portion 516 is disposed to pivot about the fulcrum projections 514 on the valve body. In order to accomplish this, two forked projections 521 are shown horizontally disposed attached to the transition portion 520. Parallel in direction to the forked projections, is a thrust plate portion 522 also attached to the transition 520 to allow the lever to pivot back and forth.

In order to bias the lever in a substantially vertical direction, a biasing means or spring 524 is shown to fit within the slot 526 in the back of the lever portion 516 and the slot 528 in the back of member 506. This spring or band is made of rubber or some other elastic material.

Referring once again to FIG. 2, the valve means 30 is shown in the closed position with the rubber spring or band 524 acting to keep the lever portion in a substantially vertical position. In this position, the thrust plate portion 522 is engaging the tubular portion 502 of the nipple gasket to close off the passageway through the tubular portion. The thrust plate portion 522 squeezes both walls of the tubular portion together against the member 512. When a cup or other demand container is pressed against the lever 518 to push it in a direction shown by arrow A in FIG. 2, the lever portion 516 will pivot about the fulcrum projections 514 and the thrust plate portion 522 will cease to engage the tubular portion, thereby opening the passageway to the liquid within the container and the liquid will flow through the tubular portion into the demand container below. Hence, without the need of external power sources such as electrical circuits and electric power supplied to activate the valve means (other than the push of the consumer itself), a simple and reliable shut-off valve means and delivery means is provided.

It will also be seen that with the preferred embodiment valve means and delivery means of applicant's invention, if it is desired to remove the portable liquid filled container 400 from the dispenser before the contents of the container are fully used, the lid 24 can be opened and the container removed with the valve means and delivery means in place on the container. During this process, no liquid will be lost from the container. The valve means and the delivery means can be removed quite simply from the container 400 by turning the knurled valve cap portion of the valve means and removing the valve means and the nipple gasket. The original cap can then be placed back on the container and the container stored in a remote area and a new container used with the same valve means in the dispenser. FIG. 5 shows how the delivery means 499 is placed intermediate the valve means and the nozzle gasket by inserting it through the aperture 510 in the valve cap 508 and allowing the planar portion 500 to sit in the bottom of the valve cap. No special requirements are therefore placed on the design of the plastic container, thereby allowing a wide variety of containers to be used with applicant's dispenser.

FIG. 2 shows a cross-section of the base means which supports the various other parts of the dispenser. The base means designated generally 26 in FIG. 2 comprises a horizontal substantially planar portion 122 which has disposed along two opposite edges, longitudinal pads 124 for support of the base unit on a table or other external support means. Any suitable material for supporting the dispenser on the external support can be used such as rubber or resilient plastic. In the preferred embodiment, a substantially vertical divider 126 extends from the horizontal planar portion 122 of the base means in an upward direction until it encounters a portion of the insulated receptacle. This divider separates the forward portion of the dispenser where the valve means 30 is located from the rear lower portion of the dispenser or rear chamber designated generally 128. Here the power supply for the thermo-electric unit, portions of the thermo-electric unit, portions of the insulated receptacle and the air circulating means are located. Base vertical walls or shroud 28 encloses this rear portion by dividing the vertical side walls and back wall for the rear chamber 128. The back wall is numbered 130 in FIG. 2, and side walls 132 and 134 are shown in FIG. 3. FIG. 3 also shows the power supply 136 and the air circulating means designated generally 140 mounted on a suitable base 142 within the rear chamber 128. The blade 138 is shown attached to the air circulating means motor 139.

Disposed in a slot in the forward direction of the horizontal planar base portion 122 is a demand container tray support means designated generally 144. When a consumer or a user actuates the valve means and receives liquid from the liquid filled container within the receptacle, there is some chance that the liquid will overflow the cup or be spilled in moving the filled demand container from the proximity of the dispenser. In addition, a user may wish to support the demand container on the dispenser base as it is being filled, while still pressing against the valve means. To provide a means for supporting a demand container and for allowing any spilled liquid to be drained from the proximity of the cup, the preferred embodiment tray support means 144 is comprised of a perforated grating 145, made of aluminum for example, and a tray 148, made of plastic. The grating 146 fits within a slot in the tray 148 and the tray slides within the slot in the horizontal planar portion 122 of the base means 120. The grating 146 can be readily removed to clean the bottom of the tray 148 or, alternatively, the entire tray and grating can be removed for cleaning. This, of course, minimizes the impact of maintaining a clean environment surrounding the dispensing of the liquid from the dispenser.

Referring once again to FIG. 2, the rear chamber not only houses the power supply, fan motor, and fan blade, but it also houses the heat exchange plate and fins of the thermo-electric device 112. The thermo-electric device is connected on one side of the thermal plate 116, which either heats or cools the thermal vessel lining 106 and the contents within the insulated receptacle 22. The other side of the thermo-electric unit 114 is connected to a heat exchange plate 150. It is necessary to exchange heat efficiently between the heat exchange plate side of the thermo-electric unit and the ambient atmosphere in order for proper operation of the thermal means 112. In order to increase the exchange area for more efficient heat exchange with the ambient atmosphere, a plurality of parallel and spaced apart substantially planar thin fins, known as heat exchange fins 152, are shown in FIG. 2 attached to the heat exchange plate 150.

The remaining portions of the thermal means 112 are the thermal protector 153 which protects the thermal unit 112 by turning off the power of the thermo-electric unit should the fins become either too hot or too cold, and a thermostat means 155 shown attached to the thermal block 116. The thermostat device 155 controls the amount of power being delivered to the thermal means 112 according to the temperature contained within the insulated receptacle. This will aid in controlling the temperature level to a pre-selected temperature level. FIG. 3 shows that, in actuality, the preferred embodiment of applicant's invention comprises two thermo-electric units 114 and two thermostats 155 shown dotted in FIG. 3.

Due to the heat created by the power supply 136 to drive the thermo-electric unit and the heat exchange requirements of the heat exchange fins 152 and heat exchange plate 150 of the thermo-electric unit, efficient air movement or ventilation through the rear chamber 128 of the dispenser is a critical requirement. To meet this requirement, applicant's preferred embodiment dispenser comprises a novel partially insulated air channel or path and optimally placed intake and exhaust vents. FIG. 3 shows a series of intake vents or openings in the side wall 132 of the shroud 28 surrounding the rear chamber. These intake vents or openings in the preferred embodiment are located near the top of the side wall 132 near the bottom of the insulated receptacle 22 and adjacent one end of the heat exchange fins 152 and block 150. When the blade 138 of the air circulating means is turning to exhaust air, it pulls air in through the openings as shown by the arrows in the proximity of the openings 154. The air will flow immediately across the heat exchange fins 152 and heat exchange plate 150. After the air has moved across and in between these fins, it is pulled downwardly by the rotation of the blade 138 in the direction of the arrows shown in FIG. 3. The air is also directed down by the generally downwardly curved member 156 shown engaging the bottom 104 of the insulated receptacle and the top portion of the side wall 134 opposite the openings 154 and adjacent the other end of the fins 152 from that end adjacent the openings 154. Hence, any air which continues to travel across the top of the rear chamber will be directed downwardly by this curved member 156.

In order to further guide the movement of air sweeping across the fins 152, the channel plate 158 is added to engage the side wall 132 just below the openings 154 and continuing horizontally across the rear chamber to engage the side wall 134 just below the downwardly curved member 156. The channel plate 158 has an aperture 160 and a downwardly directed flange 162 therearound. In the region surrounded by the downwardly directed flange 162 adjacent the aperture 160 is the blade 138. Hence, the channel for air movement through the rear chamber portion is defined partially by the channel plate 158, the downwardly directed member 156 and the downwardly directed flange 162. The air is exhausted through openings or exhaust vents 164 shown located in the wall 134 near the bottom. Exhausted air is shown by the arrows in the proximity of the openings 164.

The remaining side portions of the channel defining the movement of air through the rear chamber to properly ventilate the rear chamber are formed by the novel, downwardly directed insulation-filled channel portions 166 and 168 of the insulated receptacle 22. These channel portions are spaced apart from one another and are located on either longitudinal side of the heat exchange means of the thermo-electric unit. They are designated generally 166 an 168 in FIG. 2. In the preferred embodiment channel portion 166 extends downwardly into the rear chamber 128 for a depth that is equal to at least the depth of the heat exchange fins 152 into the chamber 128. Channel portion 166 engages the back wall 130 of the rear chamber portion. Opposite and parallel to channel portion 166 is channel portion 168 which extends equally deep into the rear chamber 138 and along with channel portion 166 extends longitudinally from side wall 132 to side wall 134 of the rear chamber. In addition, the form and location of the channel portions 166 and 168 which are integral parts of the receptacle 22 aid in positioning the receptacle above the tray portion 144, and in interacting with the vertical divider 126 and shroud 28 to provide a more positive support of the receptacle.

As much as possible, the channel for moving air through the rear chamber is confined and insulated from the liquid which is to be heated or cooled in the dispenser. The channel is formed on the top by the heat exchange plate 150; on the bottom by the channel plate 158; on the sides by the insulation-filled channel portions 166 and 168 of the receptacle 22; and on one end by the curved member 156 which leads into the region surrounded by the flange 162. Thus, a source of moving air is provided to cross along and through the heat exchange means and to sweep the heat of the rear chamber out through the remotest part of the dispenser, that is, through the rear wall near the base. In this way, a novel and most efficient air movement is generated to provide a more effective temperature controlled liquid dispenser.

It will be understood that various changes in the details, materials and arrangement of parts which have been herein described and illustrated in order to explain the nature of this invention, may be made by those skilled in the art within the principle and scope of the invention as expressed in the following claims.

What is claimed is:

1. A temperature controlled liquid dispenser for dispensing a liquid into a demand container, comprising:

(a) a heat insulated receptacle having an opening;

(b) a temperature control means in contact with a portion of said receptacle for controlling the temperature of the contents of said receptacle;

(c) a base means engaging the underside of said insulated receptacle for supporting said insulated receptacle above said demand container;

(d) a portable liquid-storage disposed in said insulated receptacle, said liquid-storage container having a nozzle portion which is disposed within said opening;

(e) a valve means for controlling the flow of liquid from said liquid-storage container, said valve means pivotal between a closed position and an open position, said valve means removably attached to said nozzle portion; and (f) a delivery means to provide a path along which said liquid can flow from said liquid-storage container toward said demand container, said delivery means comprising: a gasket nipple for insertion between said nozzle portion and said valve means, said nipple having a tubular portion, said valve means closing said tubular portion when said valve means is in the closed position, thereby preventing the flow of liquid from said liquid-storage container.

2. The invention of claim 1 wherein said valve means comprises:

(a) a valve body for ready attachment to and removal from said nozzle portion of said container, said valve body having at least one fulcrum projection, and at least one aperture through which said tubular portion of said nipple gasket passes; and (b) a lever portion for pivoting about said fulcrum projection between said closed position and said open position, said lever portion acting to close said tubular portion when said valve means is in the closed position.

3. The invention of claim 2 wherein said lever portion comprises: a downwardly extending longitudinal portion; at least one substantially horizontal forked projection for engaging said fulcrum projection; a substantially horizontal thrust plate portion to close said tubular portion when said lever portion is in the closed position; and a biasing means engaging said lever portion and said valve body to restrain said lever portion in the closed position when said dispenser is not in use.

4. A temperature controlled liquid dispenser for dispensing a liquid into a demand container, comprising:

(a) a heat insulated receptacle having at least two downwardly extending, spaced-apart heat insulation-filled channel portions;

(b) valve means for controlling the flow of liquid from said insulated receptacle;

(c) base means for supporting said insulated receptacle above said demand container, said base means comprising a rear chamber, said spaced-apart channel portions extending into said rear chamber and extending longitudinally between at least two opposite sides of said chamber;

(d) thermo-electric temperature control means for controlling the temperature of the contents of said insulated receptacle, said temperature control means having a heat exchange means for exchanging heat with the ambient atmosphere, said heat exchange means extending downwardly into said rear chamber between said channel portions, said heat exchange means extending longitudinally between said opposite sides of said chamber; and (e) air circulating means for circulating air across said heat exchange means along a path partially defined by said spaced-apart channel portions.

5. The invention of claim 4 wherein a first one of said sides of said chamber has a plurality of intake vents there-through disposed near the top of said chamber adjacent one end of said heat exchange means; and a second one of said sides having a plurality of exhaust vents therethrough disposed near the base of said chamber.

6. The invention of claim 5 wherein said dispenser further comprises a downwardly curved member disposed adjacent the opposite end of said heat exchange means from said intake vents, whereby air circulated by said circulating means is drawn into said chamber from said intake vents along said heat exchange means between said channel portions, and directed downwardly by said curved member to be exhausted through said exhaust vents.

7. The invention of claim 6 wherein said dispenser further comprises a horizontally disposed channel plate engaging said first side below and adjacent said intake vents and extending across said chamber to engage said second side, said channel plate having a ventilation aperture with a downwardly directed flange therearound to surround a portion of said air circulating means.

8. The invention of claim 4 wherein said channel portions extend down at least as far as said heat exchange means.

9. The invention of claim 4 wherein said heat exchange means comprises a plurality of parallel and spaced-apart, substantially planar fins extending longitudinally between said opposite sides, said fins disposed between said channel portions.

* * * * *